US006705562B1

(12) United States Patent
Cramer

(10) Patent No.: US 6,705,562 B1
(45) Date of Patent: Mar. 16, 2004

(54) ROLL WINDING DEVICE AND METHOD OF INCREASING RIGIDITY OF SUCH DEVICE

(75) Inventor: Dirk Cramer, Duisburg (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 460 days.

(21) Appl. No.: 09/294,354

(22) Filed: Apr. 20, 1999

(30) Foreign Application Priority Data

Apr. 28, 1998 (DE) ..... 198 18 944

(51) Int. Cl.[7] ..... B65H 18/26

(52) U.S. Cl. ..... 242/541.7; 242/542

(58) Field of Search ..... 242/541.7, 525, 242/525.5, 525.6, 525.7, 530.1, 541.5, 541.6, 548, 542, 539

(56) References Cited

U.S. PATENT DOCUMENTS 3,397,848 A * 8/1968 Haskin, Jr. et al. ... 242/525.5 X
3,497,151 A * 2/1970 Voss et al. ..... 242/541.7
5,478,026 A * 12/1995 Schonmeier et al. ..... 242/527.2
5,492,287 A 2/1996 Raudaskoski et al.
5,758,842 A * 6/1998 Dorfel et al. ..... 242/541.5 X
5,823,463 A * 10/1998 Fissmann et al. ..... 242/541.7
5,829,709 A * 11/1998 Dorfel ..... 242/541.7 X
5,839,689 A * 11/1998 Kruger et al. ..... 242/542
5,848,760 A * 12/1998 Kruger et al. ..... 242/527
5,855,337 A * 1/1999 Schonmeier et al. ..... 242/541.7
5,899,405 A 5/1999 Kruger et al.
5,996,926 A * 12/1999 Dropczynski ..... 242/541.7

FOREIGN PATENT DOCUMENTS

| | | |
|---|---|---|
| CA | 2188340 | 4/1997 |
| DE | 1111496 | 7/1961 |
| DE | 9115481 | 3/1992 |
| DE | 4201815 | 7/1993 |
| DE | 9317616 | 4/1995 |
| DE | 19624716 | 11/1996 |
| DE | 195 38 973 | 4/1997 |
| EP | 0631956 | 1/1995 |
| EP | 0769464 | 4/1997 |

* cited by examiner

*Primary Examiner*—Kathy Matecki
(74) *Attorney, Agent, or Firm*—Greenblum & Bernstein, P.L.C.

(57) ABSTRACT

Roll winding device, in particular for a reel cutter, with at least one support device, comprising at least one carrying roll disposed with its axis in the lateral direction in a machine frame, which has a column device disposed on each of the two axial ends of the carrying roll, the columns being connected to each other in the lateral direction by means of at least one cross bar. At least one cross bar is embodied as a sealing box which is disposed underneath a winding bed and has a high mechanical stability so that it considerably increases the rigidity of the frame.

46 Claims, 1 Drawing Sheet

ROLL WINDING DEVICE AND METHOD OF INCREASING RIGIDITY OF SUCH DEVICE

CROSS-REFERENCE TO RELATED APPLICATIONS

The present application claims priority under 35 U.S.C. § 119 of German Patent Application No. 198 18 944.3, filed on Apr. 28, 1998, the disclosure of which is expressly incorporated by reference herein in its entirety.

BACKGROUND OF THE INVENTION

1. Field of the Invention

The invention relates to a roll winding device, particularly useful in association with a reel cutter, comprising at least one support device comprising at least one carrying roll that is disposed with its axis in the lateral direction in the machine frame, which has a column device on the two axial ends of the carrying roll and these columns are connected to each other in the lateral direction by means of at least one cross bar. The invention also relates to a method of increasing the rigidity of such a roll winding device.

Although the description in the present specification is in connection with a roll winding device for winding a paper web, it will be readily understood that the invention and the discussion herein can be applied in the same manner with other material webs such as cardboard, films made of metal or plastic, or textile materials, and the like.

2. Discussion of Background Information

In one of the last production steps of paper manufacture, the paper web must be wound into marketable rolls. If the web has been produced in a greater width, it may also have to be brought to the correct width. In many cases, this lengthwise cutting (with respect to the axis of the web) takes place shortly before the winding.

A support device is generally provided for supporting the winding rolls during winding. This support device can, for example, comprise a winding bed that comprises two or more carrying rolls. For the sake of simplicity, all of the rolls of the support device are called carrying rolls in the present specification.

Column devices (also referenced herein as column systems) on the axial ends of the carrying rolls are provided to support the carrying rolls. In order to assure the vibrational rigidity and the stability of the entire machine frame, cross bars are usually inserted between the column devices and fixed to them. Once a stable frame has been constructed in this manner, the required functions are integrated into it.

The greatest stresses of the machine frame occur in the region of the carrying roll support. Vibrations are introduced there, for example, which are caused by imbalances in the carrying rolls that cannot be completely eliminated. In this position, however, the column devices cannot be connected directly, because the corresponding space is taken up by the carrying rolls. However, the farther the cross bars are removed from the carrying rolls, the larger in size and more stable the cross bars and the column devices must be.

SUMMARY OF THE INVENTION

The invention provides a roll winding device that has a particularly compact and inexpensive construction.

In particular, the invention provides a roll winding device of the type mentioned above by virtue of the fact that the at least one cross bar is embodied as a sealing box, which in turn is disposed beneath a winding bed and which also has a high mechanical stability so that it considerably increases the rigidity of the frame.

The sealing box is disposed in the immediate vicinity of the carrying rolls. This position is required by its function as a sealing box. When using winding beds to support the winding rolls (reels), as a rule, the winding rolls do not have to be held or supported at the winding core. Consequently, the force with which the winding roll rests on the carrying rolls of the winding bed increases as the diameter of the winding rolls increases. Therefore the contact pressure increases and with it, the winding hardness. In order to counteract this, a relief of the weight of the winding roll is produced with the aid of an air cushion. Compressed air is supplied to the winding bed to generate this air cushion. It is necessary to seal the winding bed so that the compressed air does not escape. As a consequence of this requirement, the sealing box must not be spaced too far apart from the carrying rolls.

In accordance with the invention, the sealing box, unexpectedly, can be utilized for an additional function. Specifically, it can also be used as a cross bar, which connects the two column devices to each other in the immediate vicinity of the carrying rolls. This achieves a stiffening of the machine frame right in the region where it can have the greatest effect. It is unexpected that the sealing box could be used successfully as a structural reinforcing element such as a cross bar in accordance with the present invention, because, for example, as indicated above, conventional wisdom dictates that structural reinforcing members such as cross bars must be spaced away from the carrying rolls a significant distance. Additionally, rather than providing a separate cross bar as a separate structural member, it has been unexpectedly discovered in accordance with the present invention, that the sealing box can be utilized to provide a sufficiently high mechanical stability. With higher air pressures and greater spans, the sealing box has to have a greater stability in order to prevent an outward buckling in the axial center of the winding bed, which could lead to a greater sealing problem, and thus it has been found that the sealing box may be successfully employed as a stiffening or structural element such as a cross bar.

The sealing box advantageously has a resistance moment $W_x$ of at least about $10^6$ $mm^3$ per meter of length. With this resistance moment, the sealing box is sufficiently stable to increase the rigidity of the frame. The increase in rigidity is as great as with the installation of an additional cross bar. This is true not only for the static state, where the addition of another cross bar leads to a further increase in the rigidity of the machine frame. It is particularly important, specifically in the current disclosed embodiment, that the vibrational rigidity during operation is drastically improved (reduced) through the immediate proximity of the sealing box as a cross bar to the carrying roll bearings.

The sealing box advantageously supports a guide roll, and thus, the sealing box accordance with the present invention provides multiple functions. In this manner, other cross bars can be eliminated in order to reduce costs and to save on installation space.

In an alternative or additional embodiment, a second cross bar device can be embodied as a blade cross bar on which at least one longitudinal cutting blade device is disposed so that it can move in the lateral direction. Usually, two cross bars are required in this connection; namely one for the upper blade and one for the lower blade. In comparison to another cross bar, however, the two blade cross bars can be considered together.

Advantageously, the blade cross bar is disposed adjacent to the sealing box, wherein the blade cross bar is hollow and communicates with the winding bed by way of a number of air lines distributed in the lateral direction. In this instance, the blade cross bar, for example the blade cross bar for the upper blade, is also given another function. Namely, it conducts the air, which is required for the production of a pressure cushion under the winding roll, to the desired position in the lateral direction of the machine, i.e., it is used to distribute the compressed air required for the roll relief.

Preferably, the communication takes place by way of the sealing box. As a result, the air lines are also given additional tasks. One function they perform is to carry out the air transport between the upper blade cross bar and the sealing box. Additionally, they stiffen the machine frame in the longitudinal direction because they produce another mechanical connection between the cross bars in the longitudinal direction.

In some embodiments, the invention provides a roll winding device, comprising a winding bed and at least one support device comprising at least one carrying roll. The carrying roll has a first end and a second end and a longitudinal axis and is disposed in the lateral direction with respect to the direction of travel of the web, in a machine frame comprising a column device at each of the two ends of the carrying roll. The column devices are connected to each other in the lateral direction by means of at least one cross bar. At least one cross bar comprises a sealing box that is disposed underneath the winding bed, the sealing box being constructed and arranged so as to have a high mechanical stability so that it considerably increases the rigidity of the frame.

The sealing box may have a resistance moment $W_x$ of at least about $10^6$ $mm^3$ per meter of length.

The sealing box may be constructed and arranged to support a guide roll.

The roll winding device may further comprise a second cross bar comprising a blade cross bar on which at least one lengthwise cutting blade device is disposed so that it can be moved in a lateral direction.

The blade cross bar may be disposed adjacent to the sealing box, and the blade cross bar may be hollow and in fluid communication with the winding bed by way of a plurality of air lines distributed in the lateral direction with respect to the direction of travel of the web.

The fluid communication may take place by way of the sealing box.

The roll winding device is particularly adapted for use in combination with a reel cutter.

In other embodiments, the invention provides a roll winding device, comprising:

a frame having first and second ends, the frame comprising a first column structure at the first end and a second column structure at the second end;

a winding bed comprising at least one carrying roll being disposed between the first and second column structures and being supported at a first end of the carrying roll by the first column structure and supported at a second end by the second column structure;

the first and second column structures being connected by at least one cross bar comprising a sealing box.

The sealing box in some embodiments is disposed beneath the winding bed.

The sealing box in such embodiments may be integral with the crossbar and/or may comprise a housing having at least one wall where the cross bar comprises the wall.

The sealing box in such embodiments may have a resistance moment $W_x$ of at least about $10^6$ $mm^3$ per meter of length.

The sealing box may also be constructed and arranged to support a guide roll.

The roll winding device may further comprise a second cross bar comprising a blade cross bar on which at least one lengthwise cutting blade device is disposed so that it can be moved in a lateral direction.

The blade cross bar may be disposed adjacent to the sealing box, and be hollow and in fluid communication with the winding bed by way of a plurality of air lines distributed in the lateral direction with respect to the direction of travel of the web. In such a roll winding device the fluid communication may take place by way of the sealing box.

The roll winding device may comprise an upper blade cross bar disposed above the web and a lower blade cross bar disposed below the web.

The roll winding device of the invention may be employed in combination with a reel cutter.

In other aspects, the invention provides a roll winding device, comprising:

a frame having first and second ends, the frame comprising a first vertical support member at the first end and a second vertical support member at the second end;

the first and second column structures being connected by at least one horizontal reinforcing member comprising a sealing box; and at least one carrying roll being disposed between the first and second vertical support members and being supported at a first end of the carrying roll by the first vertical support member and supported at a second end by the second vertical support member.

The sealing box may be disposed beneath the winding bed. The sealing box may comprise a housing having at least one wall and the horizontal reinforcing member may comprise the wall.

In certain embodiments, the sealing box has a resistance moment $W_x$ of at least about $10^6$ $mm^3$ per meter of length.

The sealing box may also be constructed and arranged to support a guide roll.

The roll winding device may also comprise a second cross bar comprising a blade cross bar on which at least one lengthwise cutting blade device is disposed so that it can be moved in a lateral direction. The blade cross bar may be disposed adjacent to the sealing box, and may be hollow and in fluid communication with the winding bed by way of a plurality of air lines distributed in the lateral direction with respect to the direction of travel of the web. The fluid communication may take place by way of the sealing box.

The roll winding device may comprise an upper blade cross bar disposed above the web and a lower blade cross bar disposed below the web.

In method aspects, the invention provides a method of increasing the rigidity of a roll winding device, the roll winding device comprising a frame having first and second ends, the frame comprising a first column structure at the first end and a second column structure at the second end;

a winding bed comprising at least one carrying roll disposed between the first and second column structures and being supported at a first end of the carrying roll by the first column structure and supported at a second end by the second column structure;

the method comprising connecting the first and second column structures by at least one cross bar comprising a sealing box. In such methods, the box may be disposed beneath the winding bed. The sealing box may be integral with the crossbar. The sealing box may comprise a housing having at least one wall and the cross bar may comprise the wall.

In certain methods, the sealing box has a resistance moment $W_x$ of at least about $10^6$ $mm^3$ per meter of length.

Advantageously, the sealing box is constructed and arranged to support a guide roll.

The method may further comprise providing a second cross bar comprising a blade cross bar on which at least one lengthwise cutting blade device is disposed so that it can be moved in a lateral direction. The blade cross bar may be disposed adjacent to the sealing box, and the blade cross bar may be hollow and in fluid communication with the winding bed by way of a plurality of air lines distributed in the lateral direction with respect to the direction of travel of the web. The fluid communication may take place by way of the sealing box.

The method may comprise providing an upper blade cross bar disposed above the web and a lower blade cross bar disposed below the web.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 2:
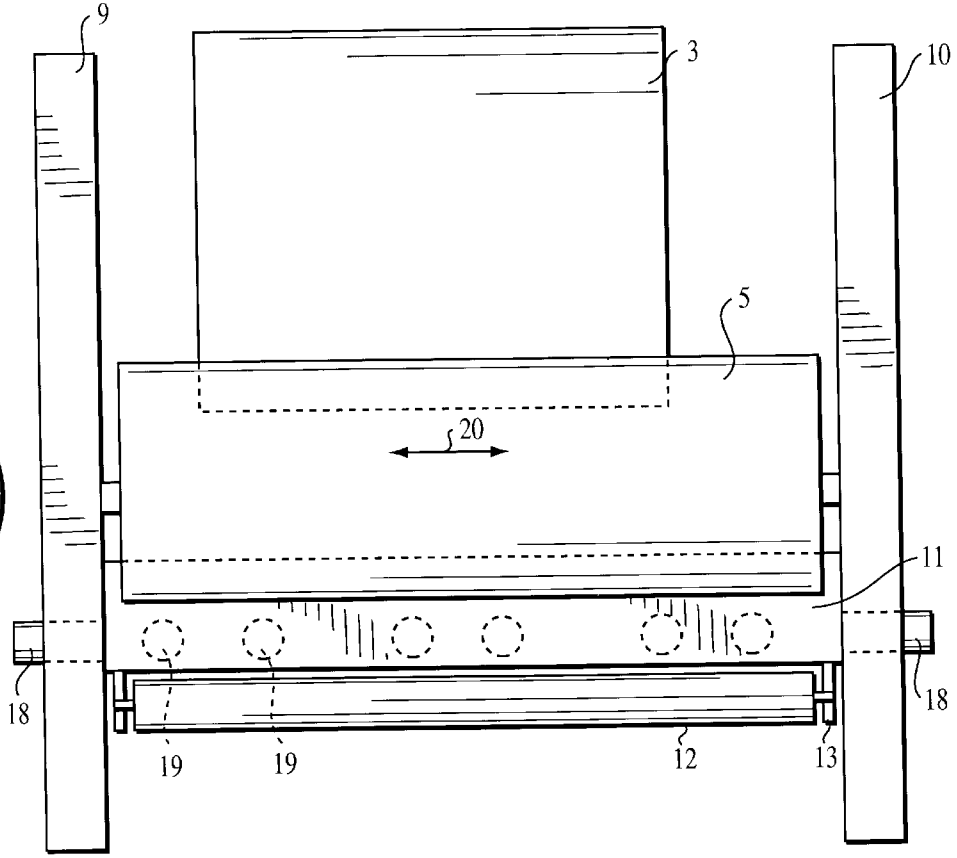
FIG. 2 is a schematic front view of a roll winding device thereof.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A roll winding device 1 is used to wind a paper web 2 or another material web into a winding roll (reel) 3. The winding roll 3 in this case rests on a winding bed 4, which comprises two carrying rolls 5, 6.

Figure 1:
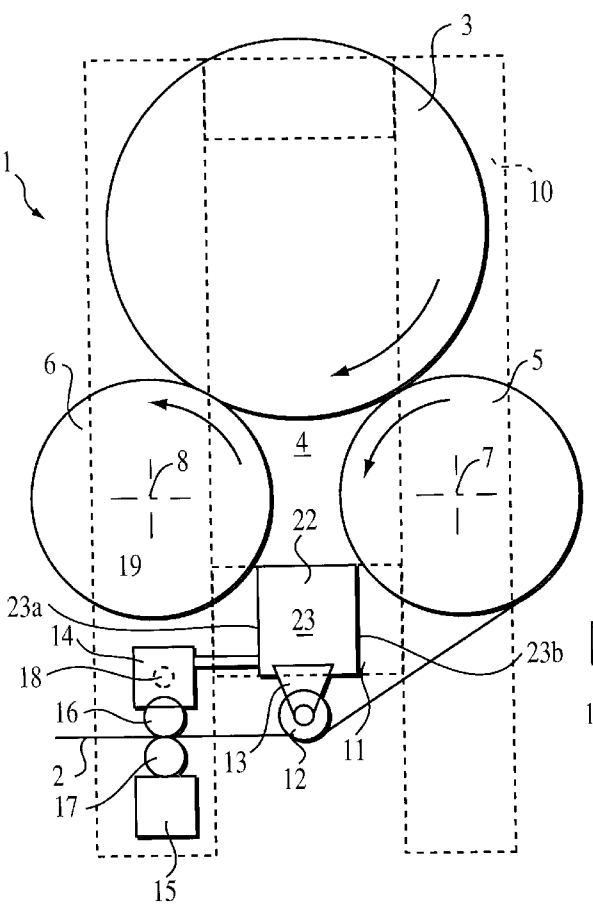
FIG. 1 is a schematic side view of a roll winding device in accordance with the present invention.

The carrying rolls 5, 6 are disposed in a machine frame with their axes 7, 8 in the lateral direction. At each of the two axial ends of the carrying roll 5, 6, the machine frame comprises a first column device (also referred to herein as a column structure) 9 disposed at a first end of the machine frame, and a second column device or structure 10 at a second end of the machine frame. These column structures 9 and 10 are depicted with dashed lines in FIG. 1 for the sake of clarity. The column structures are, in the embodiment shown, oriented generally vertically. Thus, the column structures may be in the form of first and second vertical support members.

The column devices or structures 9, 10 are connected in the lateral direction 20 by means of at least one cross bar. The cross bar may be oriented generally in the horizontal direction, and may function as a horizontal reinforcing member.

A sealing box 11 is disposed beneath the winding bed and on its top side, has an air outlet opening 22, through which the compressed air can be supplied to the winding bed 4 in order to generate a compressed air cushion for weight relief of the winding roll 3 in the winding bed 4.

The sealing box 11 has a high mechanical stability so that it can be used to stiffen the machine frame. The rigidity of the machine frame is increased considerably through the use of the sealing box 11. This is true not only for the static state because of the addition of an element that operates as a cross bar, but the sealing box cross bar has a greater influence during operation. Since it is disposed in the immediate vicinity of the carrying rolls and therefore also of the carrying roll bearing, it gives the machine frame an improved vibration fatigue limit.

The sealing box may comprise a housing 23 comprising walls 23*a* and 23*b* and one or more of these walls may comprise a cross bar or horizontal reinforcing member. Walls 23*a* and/or 23*b* may be integral with the sealing box. As used here in this context, "integral" refers to the fact that walls 23*a* and or 23*b* may form a portion of the housing of the sealing box, and may also be integrally formed with (made a part of by casting, welding, fastening or otherwise attaching) each other and/or other portions of the housing.

In addition, the sealing box 11 has guide roll 12 on its underside, which is connected to the sealing box 11 by way of a guide roll bearing block 13. In this embodiment, the sealing box 11 thus performs three functions, namely first, sealing the winding bed 4 from beneath, second, carrying a guide roll 12 for deflecting the paper web 2, and third, stiffening and stabilizing the machine frame.

In addition, in the illustrative embodiment, two other cross bars are disposed in the machine frame, which are likewise used for stiffening, namely an upper blade cross bar 14 and a lower blade cross bar 15. The upper blade cross bar supports an upper blade 16, which may be located above the web, and which cooperates with a lower blade 17. This lower blade 17 is disposed on the lower blade cross bar 15, and may be located below the web so as to function as an opposing blade, in order to cut the paper web lengthwise. Upper blade 16 and lower blade 17 operates as a reel cutter. The upper blade 16 and the lower blade 17 can be moved on their respective cross bars 14, 15 in the lateral direction in order to be able to cut different material web widths. Advantageously it is also possible for a number of upper blade/lower blade combinations to be disposed on the two blade cross bars 14, 15.

In the disclosed embodiment, the upper blade cross bar 14 is hollow. It communicates with a compressed air connection 18. Furthermore, it communicates with the sealing box 11 by way of a number of air lines 19. The upper blade cross bar 14 is disposed sufficiently close to the sealing box 11 so that the hollow upper blade cross bar 14 can also be used to distribute the compressed air required for the relief of the weight of the winding roll. The distribution of the compressed air takes place by way of air lines 19 distributed in the lateral direction, which in addition, can likewise perform a number of tasks. On the one hand, they lower the resistance for air so that pressure losses can be kept low. In addition, they increase the rigidity of the machine frame in the longitudinal direction (with respect to the direction of the travel of the web) by means of the longitudinal connection of the sealing box to the upper blade cross bar 14.

Naturally, other cross bars that are not shown can be provided, which are used only for stiffening the machine frame. By means of the sealing box 11 and if necessary, the blade cross bars 14, 15, however, some of these cross bars can be eliminated.

In method aspects, the invention provides a method for increasing the rigidity of a roll winding device by use of one or more of the structures discussed above.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A roll winding device, comprising a winding bed and at least one support device comprising at least one carrying roll having a first end and a second end and a longitudinal axis disposed in a lateral direction with respect to a direction of travel of a web, in a machine frame comprising a column device at each of the two ends of the carrying roll, said column devices being connected to each other in the lateral direction by at least one cross bar, at least one cross bar comprising a sealing box that is disposed underneath the winding bed.

2. The roll winding device of claim 1, wherein in the sealing box has a resistance moment $W_x$ of at least about $10^6$ $mm^3$ per meter of length.

3. The roll winding device of claim 1, wherein the sealing box is constructed and arranged to support a guide roll.

4. The roll winding device of claim 1, further comprising a second cross bar comprising a blade cross bar on which at least one lengthwise cutting blade device is disposed so that it can be moved in a lateral direction.

5. The roll winding device of claim 4, wherein the blade cross bar is disposed adjacent to the sealing box, and the blade cross bar is hollow and is in fluid communication with the winding bed by way of a plurality of air lines distributed in the lateral direction with respect to the direction of travel of the web.

6. The roll winding device of claim 5, wherein said fluid communication takes place by way of said sealing box.

7. The roll winding device of claim 1, in combination with a reel cutter.

8. The roll winding device of claim 1, wherein the cross bar comprising the sealing box substantially increases the rigidity of the machine frame.

9. A roll winding device, comprising:

a frame having first and second ends, said frame comprising a first column structure at said first end and a second column structure at said second end;

a winding bed comprising at least one carrying roll being disposed between said first and second column structures and being supported at a first end of said carrying roll by said first column structure and supported at a second end by said second column structure;

said first and second column structures being connected by at least one cross bar comprising a sealing box.

10. The roll winding device of claim 9, wherein said sealing box is disposed beneath said winding bed.

11. The roll winding device of claim 10, wherein the sealing box is constructed and arranged to support a guide roll.

12. The roll winding device of claim 11, further comprising a second cross bar comprising a blade cross bar on which at least one lengthwise cutting blade device is disposed so that it can be moved in a lateral direction.

13. The roll winding device of claim 12, wherein the blade cross bar is disposed adjacent to the sealing box, and the blade cross bar is hollow and is in fluid communication with the winding bed by way of a plurality of air lines distributed in the lateral direction with respect to a direction of travel of a web.

14. The roll winding device of claim 13, wherein said fluid communication takes place by way of said sealing box.

15. The roll winding device of claim 12, comprising an upper blade cross bar disposed above the web and a lower blade cross bar disposed below a web.

16. The roll winding device of claim 9, in combination with a reel cutter.

17. The roll winding device of claim 9, wherein said sealing box is integral with said crossbar.

18. The roll winding device of claim 17, wherein said sealing box comprises a housing having at least one wall and said cross bar comprises said wall.

19. The roll winding device of claim 18, wherein the sealing box has a resistance moment $W_x$ of at least about $10^6$ $mm^3$ per meter of length.

20. The roll winding device of claim 8, wherein the cross bar comprising the sealing box substantially increases the rigidity of the machine frame.

21. A roll winding device, comprising:

a frame having first and second ends, said frame comprising a first vertical support member at said first end and a second vertical support member at said second end;

said first and second vertical support members being connected by at least one horizontal reinforcing member formed by a sealing box; and at least one carrying roll being disposed between said first and second vertical support members and being supported at a first end of said carrying roll by said first vertical support member and supported at a second end by said second vertical support member.

22. The roll winding device of claim 21, wherein said sealing box is disposed beneath a winding bed.

23. The roll winding device of claim 21, wherein said sealing box comprises a housing having at least one wall and said horizontal reinforcing member comprises said wall.

24. The roll winding device of claim 23, wherein the sealing box has a resistance moment $W_x$ of at least about $10^6$ $mm^3$ per meter of length.

25. The roll winding device of claim 21, wherein the sealing box is constructed and arranged to support a guide roll.

26. The roll winding device of claim 21, further comprising a second cross bar comprising a blade cross bar on which at least one lengthwise cutting blade device is disposed so that it can be moved in a lateral direction.

27. The roll winding device of claim 26, wherein the blade cross bar is disposed adjacent to the sealing box, and the blade cross bar is hollow and is in fluid communication with a winding bed by way of a plurality of air lines distributed in a lateral direction with respect to a direction of travel of a web.

28. The roll winding device of claim 27, wherein said fluid communication takes place by way of said sealing box.

29. The roll winding device of claim 28, comprising an upper blade cross bar disposed above the web and a lower blade cross bar disposed below the web.

30. The roll winding device of claim 21, in combination with a reel cutter.

31. The roll winding device of claim 19, wherein the horizontal support member comprising the sealing box substantially increases the rigidity of the machine frame.

32. A method of increasing the rigidity of a roll winding device, the roll winding device comprising a frame having first and second ends, said frame comprising a first column structure at said first end and a second column structure at said second end, a winding bed, comprising at least one carrying roll, is disposed between said first and second column structures and is supported at a first end of said carrying roll by said first column structure and supported at a second end by said second column structure, said method comprising:

connecting said first and second column structures by at least one cross bar comprising a sealing box.

33. The method of claim 32, wherein said sealing box is disposed beneath said winding bed.

34. The method of claim 32, wherein said sealing box is integral with said crossbar.

35. The method of claim 34, wherein said sealing box comprises a housing having at least one wall and said cross bar comprises said wall.

36. The method of claim 35, wherein the sealing box has a resistance moment $W_x$ of at least about $10^6$ $mm^3$ per meter of length.

37. The method of claim 32, wherein the sealing box is constructed and arranged to support a guide roll.

38. The method of claim 32, further comprising providing a second cross bar comprising a blade cross bar on which at least one lengthwise cutting blade device is disposed so that it can be moved in a lateral direction.

39. The method of claim 38, wherein the blade cross bar is disposed adjacent to the sealing box, and the blade cross bar is hollow and is in fluid communication with the winding bed by way of a plurality of air lines distributed in the lateral direction with respect to a direction of travel of a web.

40. The method of claim 39, wherein said fluid communication takes place by way of said sealing box.

41. The method of claim 39, comprising providing an upper blade cross bar disposed above the web and a lower blade cross bar disposed below the web.

42. The method of claim 29, wherein the cross bar comprising the sealing box substantially increases the rigidity of the machine frame.

43. A roll winding device, comprising a winding bed and at least one support device comprising at least one carrying roll having a first end and a second end and a longitudinal axis disposed in a lateral direction with respect to a direction of travel of a web, in a machine frame comprising a column device at each of the two ends of the carrying roll, said column devices being connected to each other in the lateral direction by at least one cross bar, at least one cross bar comprising a sealing box that is disposed underneath the winding bed;

wherein the blade cross bar is disposed adjacent to the sealing box, and the blade cross bar is hollow and is in fluid communication with the winding bed by way of a plurality of air lines distributed in the lateral direction with respect to the direction of travel of the web.

44. A roll winding device, comprising:

a frame having first and second ends, said frame comprising a first column structure at said first end and a second column structure at said second end;

a winding bed comprising at least one carrying roll being disposed between said first and second column structures and being supported at a first end of said carrying roll by said first column structure and supported at a second end by said second column structure;

said first and second column structures being connected by at least one cross bar comprising a sealing box;

wherein the blade cross bar is disposed adjacent to the sealing box, and the blade cross bar is hollow and is in fluid communication with the winding bed by way of a plurality of air lines distributed in the lateral direction with respect to a direction of travel of a web.

45. A roll winding device, comprising:

a frame having first and second ends, said frame comprising a first vertical support member at said first end and a second vertical support member at said second end;

first and second column structures being connected by at least one horizontal reinforcing member comprising a sealing box; and at least one carrying roll being disposed between said first and second vertical support members and being supported at a first end of said carrying roll by said first vertical support member and supported at a second end by said second vertical support member;

wherein the blade cross bar is disposed adjacent to the sealing box, and the blade cross bar is hollow and is in fluid communication with a winding bed by way of a plurality of air lines distributed in a lateral direction with respect to a direction of travel of a web.

46. A method of increasing the rigidity of a roll winding device, the roll winding device comprising a frame having first and second ends, said frame comprising a first column structure at said first end and a second column structure at said second end;

a winding bed comprising at least one carrying roll being disposed between said first and second column structures and being supported at a first end of said carrying roll by said first column structure and supported at a second end by said second column structure;

the method comprising connecting said first and second column structures by at least one cross bar comprising a sealing box;

wherein the blade cross bar is disposed adjacent to the sealing box, and the blade cross bar is hollow and is in fluid communication with the winding bed by way of a plurality of air lines distributed in the lateral direction with respect to a direction of travel of a web.

* * * * *